US007999203B2

(12) United States Patent
Cheng

(10) Patent No.: US 7,999,203 B2
(45) Date of Patent: Aug. 16, 2011

(54) ELECTROLUMINESCENT KEYBOARD

(75) Inventor: Yu-Chih Cheng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 63 days.

(21) Appl. No.: 12/609,798

(22) Filed: Oct. 30, 2009

(65) Prior Publication Data

US 2011/0056814 A1 Mar. 10, 2011

(30) Foreign Application Priority Data

Sep. 4, 2009 (TW) ..... 98129808 A

(51) Int. Cl.
*H01H 9/00* (2006.01)

(52) U.S. Cl. ..... 200/310

(58) Field of Classification Search ..... 200/319, 200/341, 310, 5 A, 512, 311–317
See application file for complete search history.

(56) References Cited

U.S. PATENT DOCUMENTS 6,987,466 B1 * 1/2006 Welch et al. ..... 341/22
7,186,936 B2 * 3/2007 Marcus et al. ..... 200/310
7,283,066 B2 * 10/2007 Shipman ..... 341/22
2010/0006413 A1 * 1/2010 Chang et al. ..... 200/314

* cited by examiner

*Primary Examiner* — Edwin A. Leon
(74) *Attorney, Agent, or Firm* — Kirton & McConkie; Evan R. Witt

(57) ABSTRACT

An electroluminescent keyboard includes a plurality of membrane switch structures, a plurality of keycaps, a plurality of electroluminescent elastic members, and an electrode layer. The electroluminescent elastic members are arranged between the keycaps and respective membrane switch structures for emitting light in response to an electric current or an electric field. The electrode layer is arranged between the electroluminescent elastic members and respective membrane switch structures and electrically connected to respective electroluminescent elastic members. The electroluminescent elastic members emit light when the electric current passes through the electrode layer or the strong electric field is applied to the electrode layer. The light-emitting element and the backlight module that are used in the conventional keyboard are not included in the electroluminescent keyboard. In addition, the light could be effectively controlled to be guided to a desired luminous region of the keycap. As a consequence, the illuminated keyboard is very cost-effective.

15 Claims, 5 Drawing Sheets

ELECTROLUMINESCENT KEYBOARD

FIELD OF THE INVENTION

The present invention relates to an illuminated keyboard, and more particularly to an electroluminescent keyboard.

BACKGROUND OF THE INVENTION

With increasing development of information industries, portable information devices such as notebook computers or personal digital assistants are widely used in many instances. In a case that a portable information device is used in a dim environment, the numbers and texts marked on the keys of the keyboard of the portable information device are usually not easily identified by a user and further hinder the user from operating the keyboards. Moreover, the user is probably suffered from vision impairment. Recently, an illuminated keyboard has been developed to be used in the dim environment in order to enhance the applications thereof. Moreover, by changing the arrangement of luminous regions, the illuminated keyboard equipped with the information device is more aesthetically-pleasing and competitive.

Generally, an illuminated keyboard is equipped with a light source and a backlight module. The fabricating cost of the illuminated keyboard is highly dependent on the cost of the light source and the cost of the backlight module. For designing an illuminated keyboard, the reduction of the fabricating cost of the illuminated keyboard is usually taken into consideration. For example, U.S. Pat. No. 7,186,936 has disclosed an electroluminescent lamp membrane switch. A top electrode layer, a bottom electrode layer and a lamp layer are formed on a membrane switch, wherein the lamp layer is arranged between the top electrode layer and the bottom electrode layer. A graphics layer is imprinted on the top electrode layer. When an external voltage is applied between the top electrode layer and the bottom electrode layer, the lamp layer emits light beams to light up the graphics layer. Since the lamp layer is stacked on the membrane switch, the light beams emitted from the lamp layer are distributed over the whole surface of the keyboard. For a purpose of locally illuminating, the illuminated keyboard needs to have additional structures to limit the luminous regions.

SUMMARY OF THE INVENTION

An illuminated keyboard containing an electroluminescent material in specified components of the illuminated keys thereof is provided. The illuminated keyboard without light-emitting diodes and the backlight module may reduce the cost in fabrication.

An illuminated keyboard containing an electroluminescent material in specified components of the illuminated keys thereof is provided. Without additional component, the light is effectively guided toward a desired luminous region of the keycap and further costs less.

In accordance with an aspect of the present invention, there is provided an electroluminescent keyboard. The electroluminescent keyboard includes a plurality of membrane switch structures, a plurality of keycaps, a plurality of electroluminescent elastic members, and an electrode layer. The keycaps are disposed on and aligned with respective membrane switch structures. The electroluminescent elastic members are arranged between the keycaps and respective membrane switch structures for emitting light in response to an electric current or an electric field. The electrode layer is arranged between the electroluminescent elastic members and respective membrane switch structures and electrically connected to respective electroluminescent elastic members. The electroluminescent elastic members emit light when the electric current passes through the electrode layer or the strong electric field is applied to the electrode layer.

The above objects and advantages of the present invention will become more readily apparent to those ordinarily skilled in the art after reviewing the following detailed description and accompanying drawings, in which:

BRIEF DESCRIPTION OF THE DRAWINGS

FIGS. 2A and 1B are schematic cross-sectional views respectively illustrating illuminated keys of two exemplary electroluminescent keyboards according to a second embodiment of the present invention.

DETAILED DESCRIPTION OF THE PREFERRED EMBODIMENT

Figure 1A:
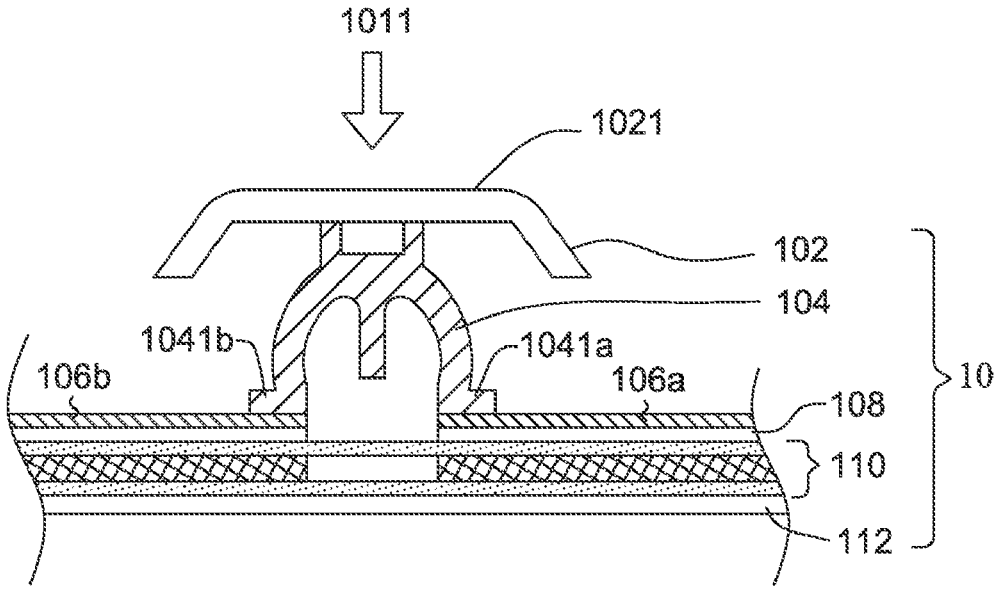
FIGS. 1A, 1B and 1C are schematic cross-sectional views respectively illustrating keys of three exemplary electroluminescent keyboards according to a first embodiment of the present invention.
Figure 1B:
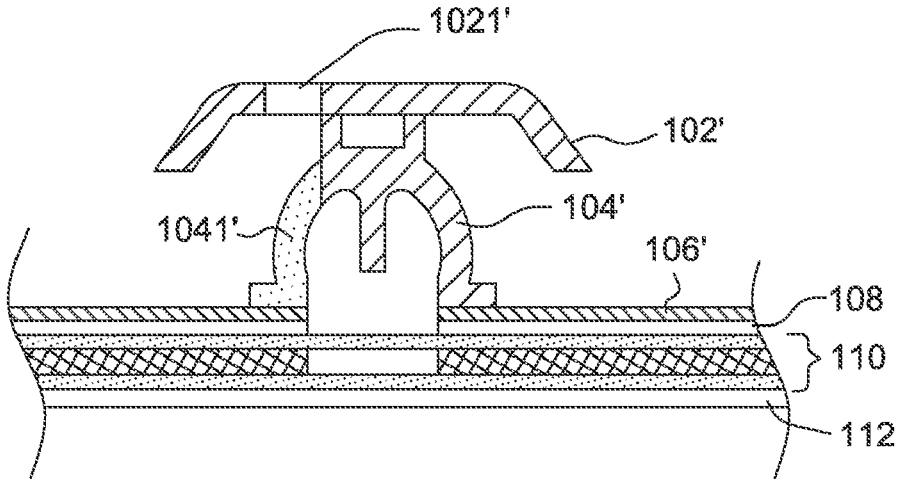
Figure 1C:
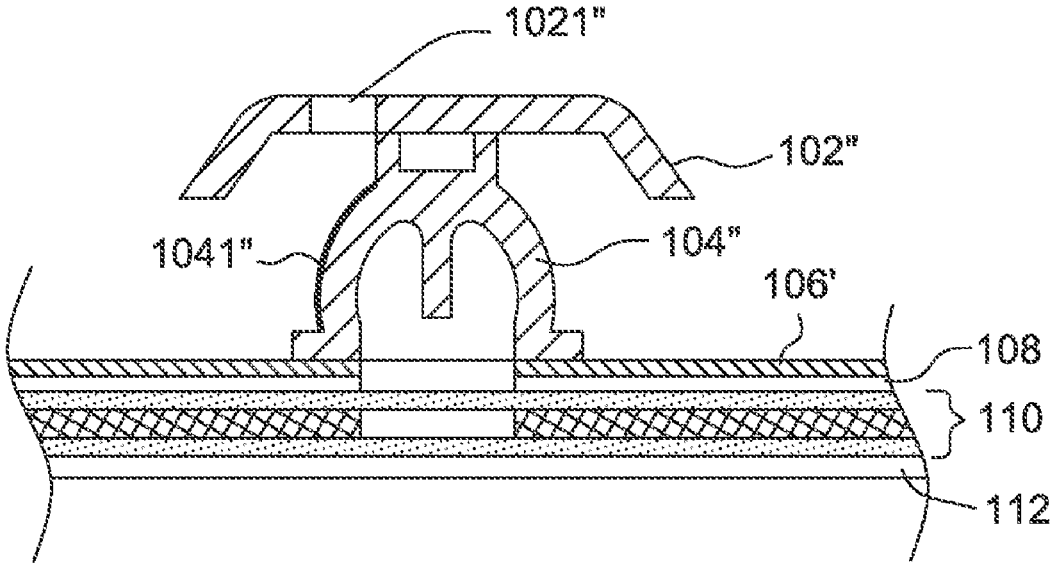

FIGS. 1A, 1B and 1C are schematic cross-sectional views respectively illustrating illuminated keys of three exemplary electroluminescent keyboards according to a first embodiment of the present invention. The configurations, shapes and arrangements of some components included in FIGS. 1A, 1B and 1C are distinguished but could be exchanged between each other. It is noted that, however, those skilled in the art will readily observe that numerous modifications and alterations may be made while retaining the teachings of the invention. The following descriptions of the electroluminescent keyboards of FIGS. 1A, 1B and 1C are presented herein for purpose of illustration and description only. As shown in FIG. 1A, the illuminated key 10 comprises a base plate 112, a membrane switch structure 110, an electrode layer (or electrode structure) 106*a*, 106*b*, an electroluminescent elastic member 104 and a keycap 102. The keycap 102 is used for sheltering the electroluminescent elastic member 104. In addition, the keycap 102 has a contact surface 1021 for receiving an external force 1011. The keycap 102 is made of a transparent material or an opaque material. Optionally, a visible image or a text or a touchable protuberance could be directly printed on the contact surface 1021. Alternatively, after the whole contact surface 1021 is coated with ink, an image, a text or a touchable protuberance on the contact surface 1021 will be formed. The contact surface 1021 could be a flat surface or a curvy surface. FIG. 1B schematic illustrates a variation of the keycap. The keycap 102' is made of an opaque material. For allowing light to penetrate through the keycap 102', the keycap 102' further comprises a light-through portion 1021'. For example, the light-through portion 1021' is a hollow portion that is filled with or covered with a transparent material.

Please refer to FIG. 1A again. The electroluminescent elastic member 104 is arranged between the keycap 102 and the membrane switch structure 110. The electroluminescent elastic member 104 could emit light in response to an electric current passing through it. In addition, the electroluminescent elastic member 104 is used for guiding the light to the keycap 102 and triggering the membrane switch structure 110 to generate an electronic signal. In an embodiment, the electroluminescent elastic member 104 is made of a composition containing a body material and an electroluminescent material. An example of the body material includes but is not limited to silicon rubber or another elastomeric material. An example of the electroluminescent material includes but is not limited to zinc sulfide, calcium sulfide, strontium sulfide, or the cooper-doped or silver-doped zinc sulfide, calcium sulfide, or strontium sulfide. In another embodiment, the electroluminescent elastic member 104 is made of the body material coated with the electroluminescent material on the surface of the electroluminescent elastic member 104. In addition, the electroluminescent elastic member 104 is dome-shaped, so that the light emitted from the electroluminescent elastic member 104 could be guided to the keycap 102. Under this circumstance, the luminous region is disposed within the covering range of the keycap 102. For example, the luminous region may be the whole region of the contact area 1021 of the keycap 102 or a specified local region of the contact area 1021.

Another light guiding means are shown in FIGS. 1B and 1C. As shown in FIG. 1B, the electroluminescent material is distributed with the portion 1041' of the electroluminescent elastic member 104' for more precisely guiding the light to the light-through portion 1021' of the keycap 102'. As shown in FIG. 1C, the electroluminescent material is coated on the portion 1041" of the electroluminescent elastic member 104" for more precisely guiding the light to the light-through portion 1021" of the keycap 102". Accordingly, by controlling the distributing condition of the electroluminescent material in the electroluminescent elastic member and the geometric shape of the electroluminescent elastic member, the light could be guided to the covering range or a desired luminous region of the keycap. Under this circumstance, the area of the illumination zone or the luminous region of the keycap could be precisely controlled. Moreover, since the electroluminescent material is distributed in the electroluminescent elastic member and the electroluminescent elastic member is directly arranged under the keycap, the possibility of causing light leakage to adjacent keys is minimized.

The electroluminescent material of the electroluminescent elastic member 104 could emit light in response to an electric current passing through it. As shown in FIG. 1A, the electrode layer (or electrode structure) 106*a*, 106*b* is disposed over the membrane switch structure 110. In addition, both terminals of the electrode layer 106*a*, 106*b* are electrically connected to two pins 1041*a* and 1041*b* of the electroluminescent elastic member 104. As shown in FIG. 1B, the electrode layer (or electrode structure) 106' is disposed over the membrane switch structure 110 and electrically connected to the two pins 1041*a* and 1041*b* of the electroluminescent elastic member 104. When an electric current passes through or an electric field is applied on both terminals of the electrode layer 106*a*, 106*b*, the electroluminescent material of the electroluminescent elastic member 104 emits visible light due to the voltage difference between the two pins 1041*a* and 1041*b*. As such, a backlight effect occurs. In accordance with a key feature of the present invention, the solid-state light-emitting element, the reflective plate and the backlight module that are used in the conventional keyboard are not included in the illuminated key 10. Please refer to FIG. 1A again. The illuminated key 10 further comprises an insulating layer 108. The insulating layer 108 is arranged between the electrode layer 106*a*, 106*b* and the membrane switch structure 110. The base plate 112 is disposed under the membrane switch structure 110. By the insulating layer 108, the electrode layer 106*a*, 106*b* and the membrane switch structure 110 are isolated from each other. In addition, the base plate 112 is used for supporting the overall weight of the keyboard.

Figure 2A:
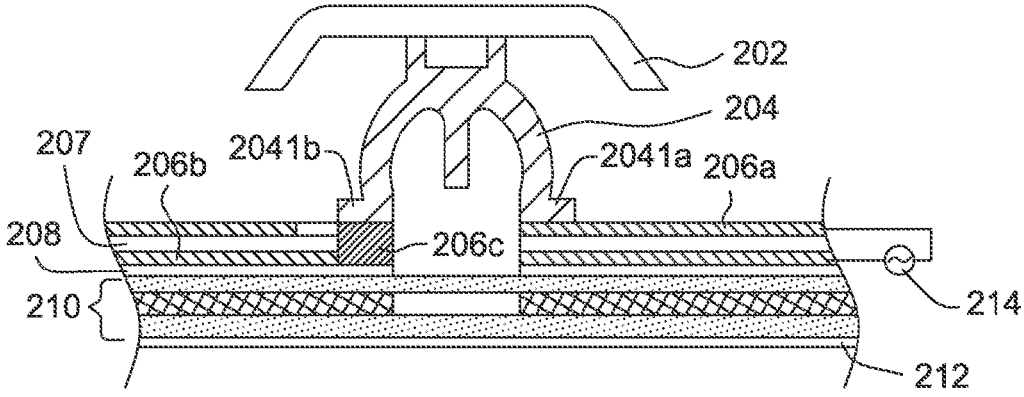
Figure 2B:
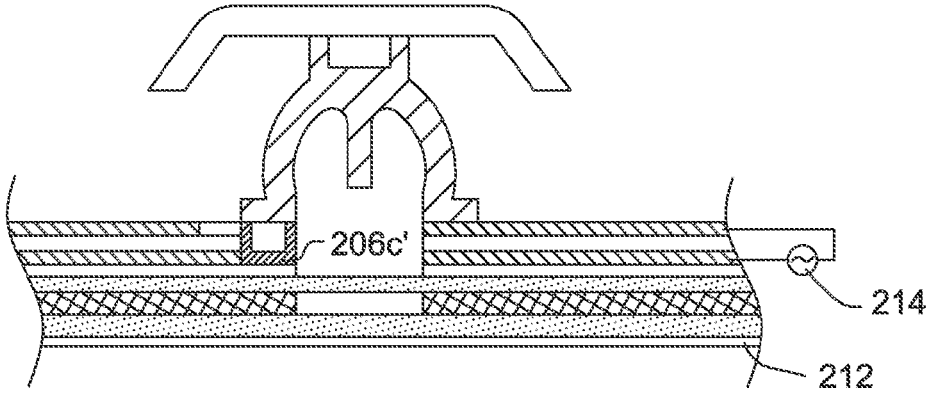

The arrangement of the electrode layers for passing an electric current through or applying an electric field on the electroluminescent elastic member is not limited to FIGS. 1A, 1B and 1C. FIGS. 2A and 1B are schematic cross-sectional views respectively illustrating illuminated keys of two exemplary electroluminescent keyboards according to a second embodiment of the present invention. As shown in FIG. 2A, two electrode layers (or electrode structures) 206*a* and 206*b* are disposed at different levels, and separated from each other by an insulating layer 207. In addition, the two electrode layers (or electrode structures) 206*a* and 206*b* are connected with a power source 214. The pin 2041*a* of the electroluminescent elastic member 204 is fixed on and electrically connected to the electrode layer 206*a*. The pin 2041*b* of the electroluminescent elastic member 204 is fixed on a conductive stud 206*c* and electrically connected to the electrode layer 206*b* through the conductive stud 206*c*. A gap between the conductive stud 206*c* and the electrode layer 206*a* by a gap ensures the electric isolation therebetween. The configurations and functions of the keycap 202, the insulating layer 208, the membrane switch structure 210 and the base plate 212 are similar to those illustrated in FIGS. 1A, 1B and 1C, and are not redundantly described herein. In another embodiment, as shown in FIG. 2B, the conductive stud 206*c* is replaced by a conductive hole 206*c'*. Under this circumstance, the electric current could be transmitted to the electroluminescent elastic member through the conductive hole 206*c'*. The configurations and functions of other components included in FIG. 2B are similar to those illustrated in FIGS. 1A, 1B and 1C, and are not redundantly described herein.

Figure 3A:
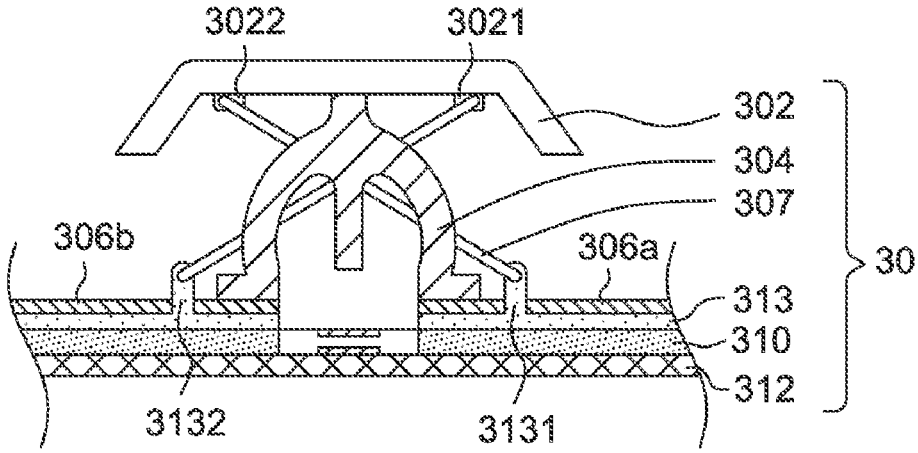
FIGS. 3A, 3B and 3C are schematic cross-sectional views respectively illustrating scissors-type illuminated keys of three exemplary electroluminescent keyboards according to a third embodiment of the present invention.
Figure 3B:
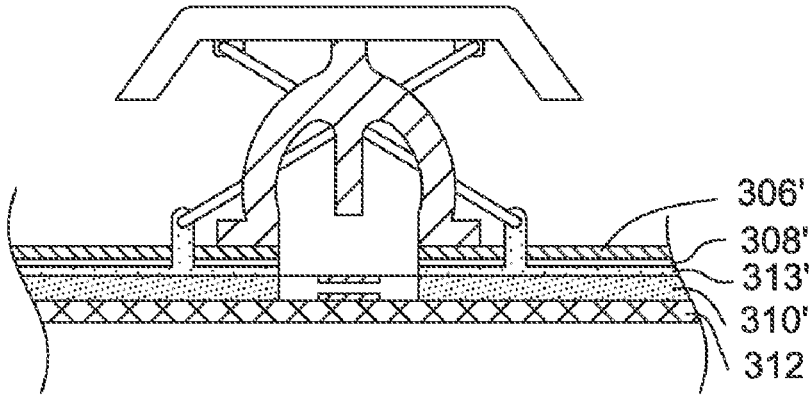
Figure 3C:
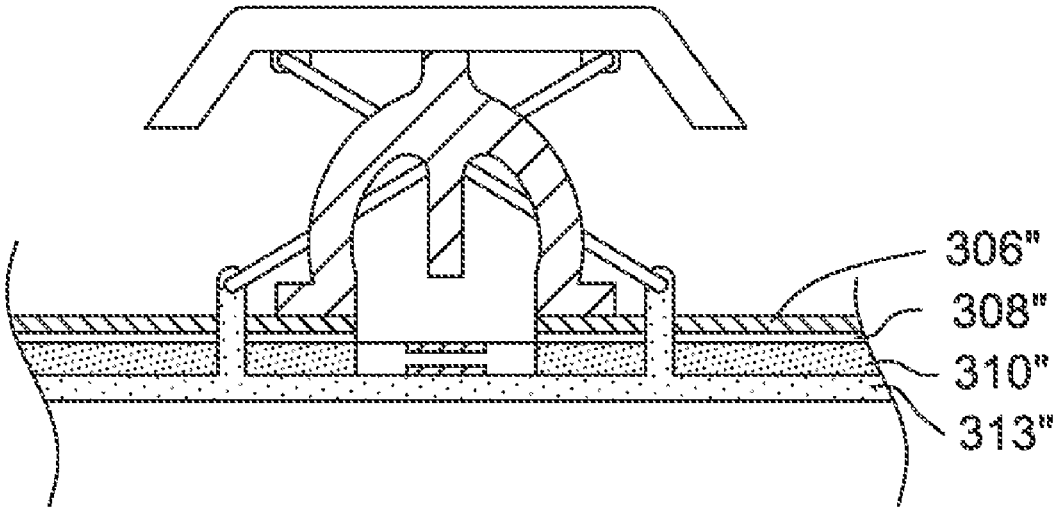

The method of adding the electroluminescent material to electroluminescent elastic member according to the present invention could be applied to other types of keys. FIGS. 3A, 3B and 3C are schematic cross-sectional views respectively illustrating scissors-type illuminated keys of three exemplary electroluminescent keyboards according to a third embodiment of the present invention. The configurations, shapes and arrangements of some components included in FIGS. 1A, 1B, 1C, 2A and 2B are distinguished but could be exchanged between each other. It is noted that, however, those skilled in the art will readily observe that numerous modifications and alterations may be made while retaining the teachings of the invention. The following descriptions of the electroluminescent keyboards of FIGS. 3A, 3B and 3C are presented herein for purpose of illustration and description only. As shown in FIG. 3A, an illuminated key 30 comprises a first base plate 312, a membrane switch structure 310, a second base plate 313, an electrode layer (or an electrode structure) 306*a*, 306*b*, a scissors-type supporting member 307, an electroluminescent elastic member 304 and a keycap 302. The configurations and functions of the first base plate 312, the membrane switch structure 310 and the electrode layer (or an electrode structure) 306*a*, 306*b* are similar to those illustrated in FIGS. 1A, 1B, 1C, 2A and 2B, and are not redundantly described herein.

In this embodiment, the scissors-type supporting member 307 has a receptacle for accommodating the electroluminescent elastic member 304. The keycap 302 has first receiving parts 3021 and 3022. The second base plate 313 has second receiving parts 3131 and 3132. In addition, the scissors-type supporting member 307 is connected with the keycap 302 and the second base plate 313 through the first receiving parts 3021, 3022 and the second receiving parts 3131, 3132, respectively. The scissors-type supporting member 307 comprises a plurality of rotatable arm elements. When an external force is exerted on the keycap 302, the arm elements are pivoted to be in a folded status. Whereas, in a case that the external force is eliminated, the arm elements are pivoted to be in a stretched status. In some embodiments, the electroluminescent material is added into some other components of the illuminated key 30. For example, the scissors-type supporting member 307 also contains the electroluminescent material. In the cooperation of a suitable electrode layer, the scissors-type supporting member 307 has an electroluminescent effect. Moreover, the second base plate 313 is arranged between the electrode layer 306*a*, 306*b* and the membrane switch structure 310. In a case that the second base plate 313 is made of an insulating material, the second base plate 313 could be served as an insulating layer between the electrode layer 306*a*, 306*b* and the membrane switch structure 310. In another embodiment, as shown in FIG. 3B, the second base plate 313' is made of a conducting material (e.g. a metallic material). Under this circumstance, an insulating layer 308' is arranged between the electrode layer 306' and the second base plate 313'; the insulating layer 308' is arranged between the second base plate 313' and the membrane switch structure 310'. In another embodiment, as shown in FIG. 3C, the first base plate and the second plate are integrated into a single base plate 313". The base plate 313" is disposed under the membrane switch structure 310" for supporting other components of the keyboard.

In the above embodiments, the electroluminescent elastic member connected to the electrode layer emits light when an electric current passes through the electrode layer or the strong electric field is applied to the electrode layer. In other words, the electroluminescent elastic member of the electroluminescent keyboard of the present invention could be deemed as a light source. Since no solid-state light-emitting element is required, the power consumption of the electroluminescent keyboard is reduced. In addition, the backlight module used in the conventional illuminated keyboard is omitted, so that the electroluminescent keyboard of the present invention is more cost-effective. Moreover, by controlling the geometric shape of the electroluminescent elastic member, the emitted light could be guided to bottom surface of the keycap, so that the keycap looks completely illuminated for the user. Since the electroluminescent elastic member is arranged directly under the keycap structure, the light emitted from the electroluminescent elastic member is not hindered by other components and a good electroluminescent effect is achieved. Moreover, since only the electroluminescent elastic member could emit light, a localized illuminating efficacy is achieved. Since the elastic member is an essential component of the common scissors-type switch membrane key, no additional component is required. In other words, the electroluminescent keyboard of the present invention has reduced fabricating cost.

The external power source for generating the electric current to pass through the electrode layer or generating the strong electric field to be applied on the electrode layer is diversified. For example, the external power source is supplied by a circuit board of the electronic device. Alternatively, the electric current flows to the pins of the electroluminescent keyboard through a conductive wire in a wired transmission manner. Alternatively, the electroluminescent keyboard has a built-in battery for providing a DC current, so that an electric current passes through the electrode layer or the strong electric field is applied to the electrode layer to have the electroluminescent elastic member to emit light. In some embodiments, the electroluminescent keyboard is electrically connected to an external electronic device. By turning on the external electronic device or the powering on the electroluminescent keyboard, an electric current passes through the electrode layer. In some embodiments, the electroluminescent keyboard has a hot key or a control key. By operating the hot key or the control key, the electroluminescent function of the electroluminescent keyboard is enabled or the electroluminescent keyboard is powered off according to the practical requirements. In some embodiments, the electroluminescent material could still emit the light after the electric current or the strong electric field is interrupted for a time period (i.e. an afterglow time). Under this circumstance, the electroluminescent function of the electroluminescent keyboard is maintained for the afterglow time.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electroluminescent keyboard comprising:

a plurality of membrane switch structures;

a plurality of keycaps disposed on and aligned with respective membrane switch structures;

a plurality of electroluminescent elastic members arranged between said keycaps and respective membrane switch structures for emitting light in response to an electric current or an electric field; and an electrode layer arranged between said electroluminescent elastic members and respective membrane switch structures and electrically connected to respective electroluminescent elastic members, wherein said electroluminescent elastic member emits light when said electric current passes through said electrode layer or said strong electric field is applied to said electrode layer.

2. The electroluminescent keyboard according to claim 1 wherein each of said electroluminescent elastic members is made of a composition containing a body material and an electroluminescent material, thereby guiding said light to a corresponding keycap.

3. The electroluminescent keyboard according to claim 1 wherein each of said electroluminescent elastic members is made of a body material and an electroluminescent material is distributed on a surface of said body material, thereby guiding said light to a local region of a corresponding keycap.

4. The electroluminescent keyboard according to claim 1 wherein each of said electroluminescent elastic members contains an electroluminescent material selected from a group consisting of zinc sulfide, cooper-doped zinc sulfide, silver-doped zinc sulfide, calcium sulfide, strontium sulfide, and a combination thereof.

5. The electroluminescent keyboard according to claim 1 wherein said electrode layer comprises a first electrode and a second electrode, wherein said first electrode and said second electrode are arranged at the same layer and electrically to said electroluminescent elastic members.

6. The electroluminescent keyboard according to claim 1 wherein said electrode layer comprises a first electrode, a second electrode and an insulating layer, wherein said first electrode and said second electrode are arranged at different layers, said insulating layer is arranged between said first electrode and said second electrode, and said first electrode and said second electrode are electrically to said electroluminescent elastic members.

7. The electroluminescent keyboard according to claim 1 further comprising an insulating layer to electrically isolate said electrode layer from said membrane switch structures.

8. The electroluminescent keyboard according to claim 1 further comprising a base plate, wherein said membrane switch structures are disposed on said base plate.

9. The electroluminescent keyboard according to claim 1 further comprising a plurality of scissors-type supporting members, wherein said scissors-type supporting members have respective receptacles for accommodating respective electroluminescent elastic members.

10. The electroluminescent keyboard according to claim 9 further comprising:

a first base plate disposed under said membrane switch structures; and a second base plate arranged between said electrode layer and said membrane switch structures, wherein said scissors-type supporting members are connected with respective keycaps and said second base plate.

11. The electroluminescent keyboard according to claim 9 further comprising a base plate disposed under said membrane switch structures, wherein said scissors-type supporting members are connected with respective keycaps and said base plate.

12. The electroluminescent keyboard according to claim 1 further comprising a control key for controlling whether said electric current passes through said electrode layer.

13. The electroluminescent keyboard according to claim 12 further comprising a power source, which is included in said electroluminescent keyboard.

14. The electroluminescent keyboard according to claim 12 wherein said electroluminescent keyboard is electrically connected to an external electronic device, so that said electric current flows from said external electronic device to said electroluminescent keyboard.

15. The electroluminescent keyboard according to claim 1 wherein said electroluminescent keyboard is electrically connected to an external electronic device, so that said electric current flows from said external electronic device to said electroluminescent keyboard.

* * * * *